United States Patent [19]

Nuttall et al.

[11] 4,099,644

[45] Jul. 11, 1978

[54] LOW EMISSION MULTIPLE SEALING SYSTEM FOR FLOATING ROOF TANKS

[75] Inventors: Wayne E. Nuttall, San Gabriel; William H. Page, Long Beach, both of Calif.

[73] Assignee: United States Steel Corporation, Pittsburgh, Pa.

[21] Appl. No.: 783,255

[22] Filed: Mar. 31, 1977

Related U.S. Application Data

[63] Continuation-in-part of Ser. No. 674,354, Apr. 7, 1976, abandoned.

[51] Int. Cl.[2] ..... B65D 87/20

[52] U.S. Cl. ..... 220/225; 220/222

[58] Field of Search ..... 220/216–227

[56] References Cited

U.S. PATENT DOCUMENTS

| | | | |
|---|---|---|---|
| 1,693,468 | 11/1928 | Schürmann | 220/226 |
| 1,735,461 | 11/1929 | Haupt | 220/224 |
| 1,893,162 | 1/1933 | Cranz | 220/222 |
| 2,054,693 | 9/1936 | Einbeck | 220/222 X |
| 2,260,021 | 10/1941 | Gruening et al. | 220/225 X |
| 2,847,142 | 8/1958 | McClintock et al. | 220/222 |
| 2,987,215 | 6/1961 | Joor | 220/224 |
| 3,002,828 | 10/1961 | Find et al. | 220/225 |
| 3,438,215 | 4/1969 | Frijlink | 220/222 X |
| 3,511,406 | 5/1970 | Creith et al. | 220/222 |
| 3,589,549 | 6/1971 | Heisterberg | 220/222 |

FOREIGN PATENT DOCUMENTS

| | | | |
|---|---|---|---|
| 540,391 | 12/1931 | Fed. Rep. of Germany | 220/224 |
| 593,766 | 3/1934 | Fed. Rep. of Germany | 220/226 |
| 2,358,636 | 7/1974 | Fed. Rep. of Germany | 220/224 |
| 28,746 | 3/1971 | Japan | 220/226 |
| 811,648 | 4/1959 | United Kingdom | 220/225 |

*Primary Examiner*—Stephen Marcus

*Attorney, Agent, or Firm*—William A. Danchuk

[57] ABSTRACT

A low emission multiple sealing system for a floating roof liquid hydrocarbon storage tank is provided. The sealing system utilizes a double sealing arrangement in addition to, in a preferred embodiment, a conventional weather seal. The double sealing arrangement includes two functionally independent generally toroidal shaped sealing elements positioned one above the other and filling the annular gap between the floating roof and the inner surface of the storage tank. In order to provide for increased sealing efficiency and to eliminate the deleterious effects of wind and other ambient conditions, the double sealing elements are configured having effective vapor sealing efficiencies and are separated from one another a distance which will maximize the runback, to the tank, of liquid left on the inner storage tank wall during diurnal contraction and/or on liquid hydrocarbon unloadings. Additionally, elements are provided in the volumetric space between the two seals for minimizing the volume between the two in order to create a more easily saturated space. As a result, runback of liquid to the tank is increased. The specific configuration of the seals and their spacing relative to one another and to the floating roof provides for a more efficient low emission sealing system for reducing vapor emissions to the ambient atmosphere.

20 Claims, 13 Drawing Figures

LOW EMISSION MULTIPLE SEALING SYSTEM FOR FLOATING ROOF TANKS

CROSS REFERENCE TO RELATED APPLICATIONS

This application is a continuation-in-part of our copending application, Ser. No. 674,354, filed Apr. 7, 1976, now abandoned.

BACKGROUND OF THE INVENTION

The use of floating roof tanks for storage of crude oil and petroleum products (liquid hydrocarbons) of more than 1.5 PSIA true vapor pressure has become a preferred practice in the oil industry for a number of years. For the most part, this is due to a reduction of hydrocarbon vapor emissions and improved safety of floating roof tanks in general when compared with cone roof tanks.

The floating roof tank achieves a high percentage reduction of evaporation loss, as compared with an atmospheric pressure tank, inasmuch as the floating roof floats upon the product and the air space in contact with the volatile liquid is almost completely eliminated. Accordingly, the small air space left becomes easily saturated and prevents further substantial vaporization of the liquid hydrocarbon into the saturated air space.

Floating roofs are of three general types: pan, pontoon and double deck. Various versions of these basic types of roofs are manufactured and are tailored to emphasize some particular feature such as vapor trapping, full liquid contact, load carrying capacity, or roof stability. Selection of a specific type of roof depends upon the properties of the product stored, particularly vapor pressure and corrosive nature, and the roof stability required under service conditions. The least costly pan type roof is also the least stable and offers the least protection against product heating. The more costly double deck roof provides good stability as well as insulation to minimize the excessive heating of stored products. Heating of products should be avoided because it is the cause of excessive evaporation loss.

All of the classes of floating roofs mentioned provide an annular rim space between the tank shell and the floating roof to permit installation and maintenance of the sealing mechanism. A sealing mechanism is necessary because the floating roofs cannot be made to precisely fit within the confines of the storage tank itself.

In order to obtain the full benefit of a floating roof as a vapor conservation device, the annular rim space between the storage tank and the floating roof must be fitted with a tight seal. A good sealing element will close this space effectively while permitting normal roof movement due to loading and unloading as well as to diurnal expansion and contraction, the latter being due to an increase and decrease in liquid volume within the tank due to an increase in temperature during the day and a decrease in ambient temperature during the night. In this manner, the floating roof moves upwardly and downwardly slight amounts during the course of a normal 24 -hour period. Another reason for a seal between the floating roof and the tank structure itself is the lack of absolute perfection in the building of the tank resulting in an out-of-roundness which a dimensionally static seal would not be able to accommodate. Moreover, the mechanism that provides the sealing force for most seals also serves to keep the floating roof centered in the middle of the tank with substantially equalized pressure about the sealing member.

Two types of annular sealing members have been provided in the past. These have taken a form of both metallic as well as nonmetallic seals. Due to the general lack of use of metallic seals in the last few years, only nonmetallic seals wll be discussed. Nonmetallic seals are a relatively recent development in the search for more effective sealing assistance. They were used sparingly many years ago, but have come into prominence in the past 10 to 15 years. The identifying characteristic of nonmetallic seals is that they use a coated fabric band in sliding contact with the tank shell. Liquid pressure, gas pressure, or resilient foam are sometimes used to provide the necessary forces to expand the seal against the tank shell and provide a more efficient sealing system.

Nonmetallic seals have two major advantages: flexibility and elimination of the large undesirable annular air vapor space normally prevalent in steel shoe type sealing systems. The flexibility of nonmetallic seals results in a better conformity to the tank shell and, consequently, a better seal. Normally, the seals are placed in direct contact with the stored product which prevents the occurrence of any vapor space in the tank and, consequently, eliminates breathing loss. The seals themselves are generally manufactured from a fabric which may have any one of a number of different specifications. Due to the fact that all fabrics contribute to permeation losses, the area of fabric within any sealing arrangement should be minimized. Seal manufactures have recently developed as many fabric products for nonmetallic seals as there are needs.

Nonmetallic seals have, heretofore, been susceptible of one major criticism. Specifically, the flexible or nonmetallic seals do not exhibit as much potential contact area with the inner surface of the storage tank as do metallic seals. Any gap extending to the product surface may easily cause vapor less to the ambient atmosphere. Moreover, wind and wind eddying increases this loss.

The annular rim space between the tank shell and the floating roof is the principal source of evaporation loss. Heretofore, it was suggested with some certainty that there are only two major ways in which evaporation loss occurred in the seal area of a floating roof tank. These were evaporation through the space between the seal and the tank shell which might be referred to as a diffusional loss and a vapor permeation through the sealing fabric. It has also been shown that a third major area of concern regarding evaporation losses from floating roof tanks is that of evaporation of liquid left on the inner surface of the storage tank subsequent to movement of the floating roof downwardly due to diurnal contraction and/or liquid unloading. Due to the fact that presently available sealing systems do not anticipate this as a major source of evaporation loss, they are ineffective in their attempts to substantially reduce evaporation losses resultant from this cause.

The losses between the seal and the tank shell may occur by evaporation from exposed product surfaces or from product wicking up the tank shell or both. Product exposure may result from poor fitting seals, or may occur at shell irregularities, e.g. rivet heads or shell discontinuities. Vapos which form between the sealing ring and the tank shell must travel upward through the depth or vertical length of the seal to escape. For a given gap, the deeper the sealing element, the more effective the seal in preventing loss. As noted previously, wind increases this loss. Under the force of wind action, air enters the space between the seal and the tank shell, sweeping out vapor at a rate which increases with the wind velocity. Furthermore, the play of wind across the roof of the tank may cause eddy currents with resultant areas of reduced pressure near the rim of the roof. These areas of reduced pressure induce flow past the seal. Laboratory tests have shown in many cases the losses from vapor permeation through the sealing fabric are so small as to become negligible.

The quantitative amounts of losses due to evaporation from floating roof storage tanks have generally been tolerated in the past. However, recently governmental regulations have tended to become more restrictive in hydrocarbon vapor emissions to the point that heretofore "small" emissions from floating roof tanks are considered excessive. As a result, the rather ineffectual sealing systems of the past have become even more unacceptable due to the more stringent requirements being promulgated by governmental agencies. Consequently, a new sealing system, based in part upon a new evaporation loss theory, was devised.

SUMMARY OF THE INVENTION

The present invention is addressed to a new sealing system for reducing vapor losses by eliminating or at least minimizing the effects of wind or convective currents across the top of the seal, thus eliminating vapor flows induced by these movements, to produce additional resistance against diffusion of vapors past the seal to the atmosphere, to eliminate losses due to capillary action, to minimize losses due to permeation of vapors through the seal fabric, and to reduce losses resulting from liquids clinging to the inner surface of the storage tank during diurnal movements and/or loading and unloading procedures. While various previous systems have attempted to accomplish the same ends as the present one, it should be noted that the vapor losses from liquid hydrocarbon storage tanks employing the present invention are 90% less as compared to those presently estimated from the older designs.

The low emission sealing arrangement of the present invention utilizes a double resilient seal including a lower sealing element and an upper sealing element adapted to fit in the annular space between the floating roof and the inner surface of the storage tank. A volume reducing element is placed between the two sealing elements for reducing if not minimizing the volume between the two. Both the first and second sealing elements are of substantially equal sealing efficiency for reducing diffusion past the sealing arrangement and are so arranged, together with the volume reducing element, relative to the floating roof, the inner surface of the storage tank and to each other that they form a strategic volumetric space between each other which is operative to reduce diffusion past the sealing arrangement. The vertical length of contact between each of the seals and the inner surface of the storage tank must be of a size to provide a diffusion path of effective length. Should the vertical length of contact between seals and the tank surface be small, there would not be an effective length of diffusion path and vapor would escape from the liquid being stored to the ambient atmosphere.

The present invention realistically recognizes that seal gaps do exist even in the best of resilient seals. However, by providing two reasonably tight resilient seals, vertically separated from one another, there is created a stagnant layer of vapors between the two seals. With the formation of a stagnant layer of vapor above the primary seal, vapor losses to the ambient atmosphere are confined to the mechanism of diffusion through the primary seal gap and permeation through the seal fabric. With the additional volume reducing element, even the stagnant vapor layer above the primary seal is reduced, thereby reducing the escaping vapors.

Since wind currents tend to reduce the effective seal diffusion path lengths, and may, on occasion, cause reduced pressures above the top seal, it is important that the upper seal diffusion path be more than a simple rubbing or scraping edge. The prior art in this regard, i.e., a primary diffusion seal and a second weather seal, is replete with a plethora of various mechanisms and means for sealing vapors within the tank and, in the case of weather seals, for preventing the entrance of elements into the storage tank and/or for effecting the efficiency of the primary diffusion seal. Examplary of such systems are those shown in U.S. Pat. Nos. 3,333,725; 3,338,454; 2,735,573; and 3,900,127. In effect, all present sealing arrangements including the ones noted above, fail to recognize the importance of a multiplicity of efficient vapor sealing elements, for reducing polluting vapor emissions to the ambient atmosphere. Their use of "secondary seals" is predicated upon an assumption that one primary seal is sufficient to prevent the escape of vapor emissions, the "secondary seal" being employed to keep precipitation, etc. from getting into the tank. It should be noted in this regard that the double seal arrangement of the present invention is not merely the combination of a primary seal and weather seal. For effective operation of the present invention, both the first and second seal must be of diffusion sealing efficiency and be substantially equal to each other in sealing efficiency. The present invention further recognizes that an effective upper seal is also required to trap evaporating liquid between the two seals as the tank roof is lowered during diurnal contraction and/or liquid unloading. Should the vapor space between the seals be saturated at this time, excess liquid on the wall, being unable to evaporate, will fall back past the lower seal into the liquid contents of the tank. Without the effects of an upper seal contemplated by this invention, the material remaining on the inner surface of the tank wall, subsequent to floating roof descension, would evaporate to the atmosphere and defeat the major purpose of an effective sealing system.

The specific seal design of the present invention minimizes the fabric area exposed to permeation and provides double barriers which prevent the substantial escape of vapors from the storage tank to the ambient atmosphere. Consequently, there is a minimization of losses caused by vapors permeating the sealing fabric of both the first and second sealing elements.

Accordingly, it is the primary object and feature of the present invention to provide for a more effective low emission vapor sealing arrangement adapted for use with a floating roof for a liquid hydrocarbon storage tank.

It is another primary object and feature of the present invention to provide for a multiple element low emission vapor sealing arrangement adapted for use with a floating roof for a liquid hydrocarbon storage tank for substantially reducing vapor emissions to the ambient atmosphere from the liquid stored in such storage tanks.

It is a general object and feature of the present invention to provide for a multiple element low emission vapor sealing arrangement for a floating roof of a liquid hydrocarbon storage tank, each of the multiple sealing elements being of an equally effective vapor sealing efficiency.

It is another general object and feature of the present invention to provide for a multiple sealing element low emmision vapor sealing arrangement adapted for use with a floating roof for a liquid hydrocarbon storage tank in combination with a weather sealing element positioned upon the floating roof between the multiple sealing elements and the ambient atmosphere.

It is another object and feature of the present invention to provide for a low emission sealing arrangement adapted for use in a liquid storage tank of the variety having a floating roof of a diameter slightly less than the diameter of such tank, the sealing arrangement having a total vertical dimension sufficient to contain a large proportion of the evaporation of any liquid left on the inner surface of such storage tank during normal diurnal and unloading descension of the floating roof within the storage tank and provide the necessary time, during descension, for product run-back to the storage tank.

It is still another object and feature of the present invention to provide for a low emission sealing arrangement adapted for use in a liquid storage tank of a variety having a floating roof for substantially eliminating vapor loss to the ambient atmosphere due to vapor diffusion past the sealing arrangement and liquid evaporation from the inner surface of the storage tank to the ambient atmosphere due to floating roof descension within the storage tank.

Other objects and features will, in part, be obvious and will, in part, become apparent as the following description proceeds. The features of novelty which characterize the invention will be pointed out with particularity in the claims annexed to and forming part of the specification.

BRIEF DESCRIPTION OF THE DRAWINGS

The novel features that are considered characteristic of the invention are set forth with particularity in the appended claims. The invention itself, however, both as to its structure and its operation together with additional objects and advantages thereof will best be understood from the following description of the preferred embodiment of the invention when read in conjunction with the accompanying drawings wherein:

DETAILED DESCRIPTION OF THE INVENTION

Figure 1:
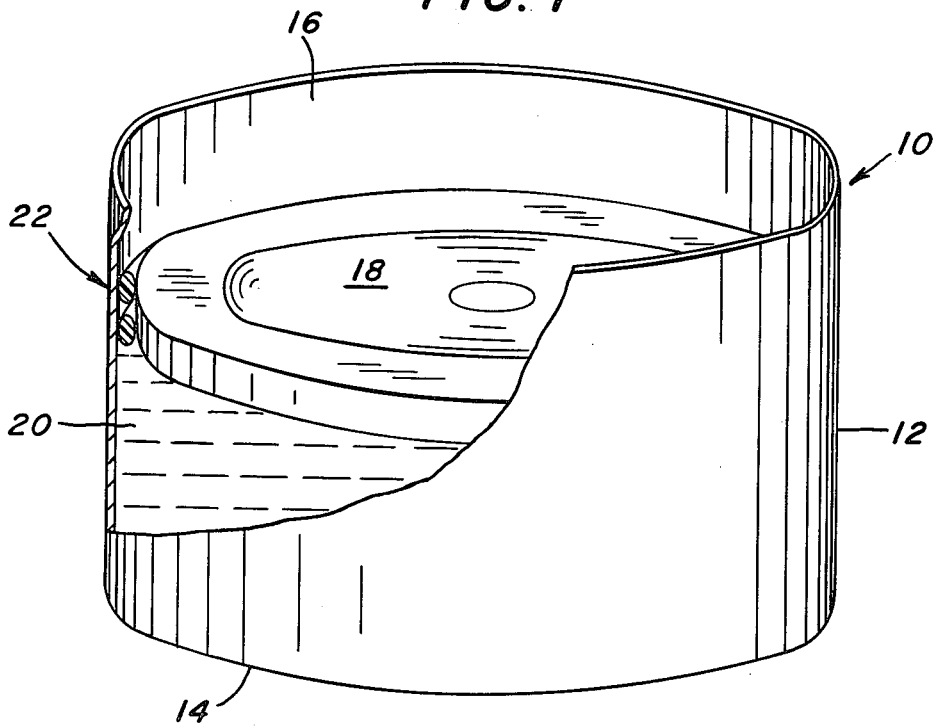
FIG. 1 is a perspective view of a liquid hydrocarbon storage tank having a floating roof with which the apparatus of the present invention is employed, the perspective view having certain portions cut away to more clearly show internal details.

FIG. 1 illustrates a perspective view of a conventional storage tank 10, for storing large quantities of hydrocarbon liquid product 20 such as petroleum or any one of its various byproducts. Tank 10 has a generally cylindrical shape formed from substantially cylindrical vertical side walls 12, a bottom 14, and an open top 16. A floating roof 18 floats upon the top of the liquid 20 contained within the storage tank for preventing substantial evaporation losses of the liquid to the ambient atmosphere.

A floating roof 18 may take any one of a variety of configurations such as a pan-type floating roof, a pontoon-type floating roof or a double deck floating roof. For purposes of clarity in this application, it is assumed that floating roof 18 is of the pontoon floating roof variety. The floating roof 18, for a variety of reasons, is of a slightly smaller diameter size than that of the storage tank 10. Accordingly, for effectively sealing of the liquid 20 contained within the storage tank 10 from evaporation, it is necessary to provide a flexible sealing arrangement between the outer edge of the floating roof 18 and the inner surface of the side wall 12 of storage tank 10. Such a sealing arrangement is shown generally at 22. In order to appreciate the various parameters affecting vapor losses in a liquid hydrocarbon storage tank, it is necessary to schematically represent a model of a sealing arrangement situation. Accordingly, attention should be drawn to FIG. 2.

Figure 2:
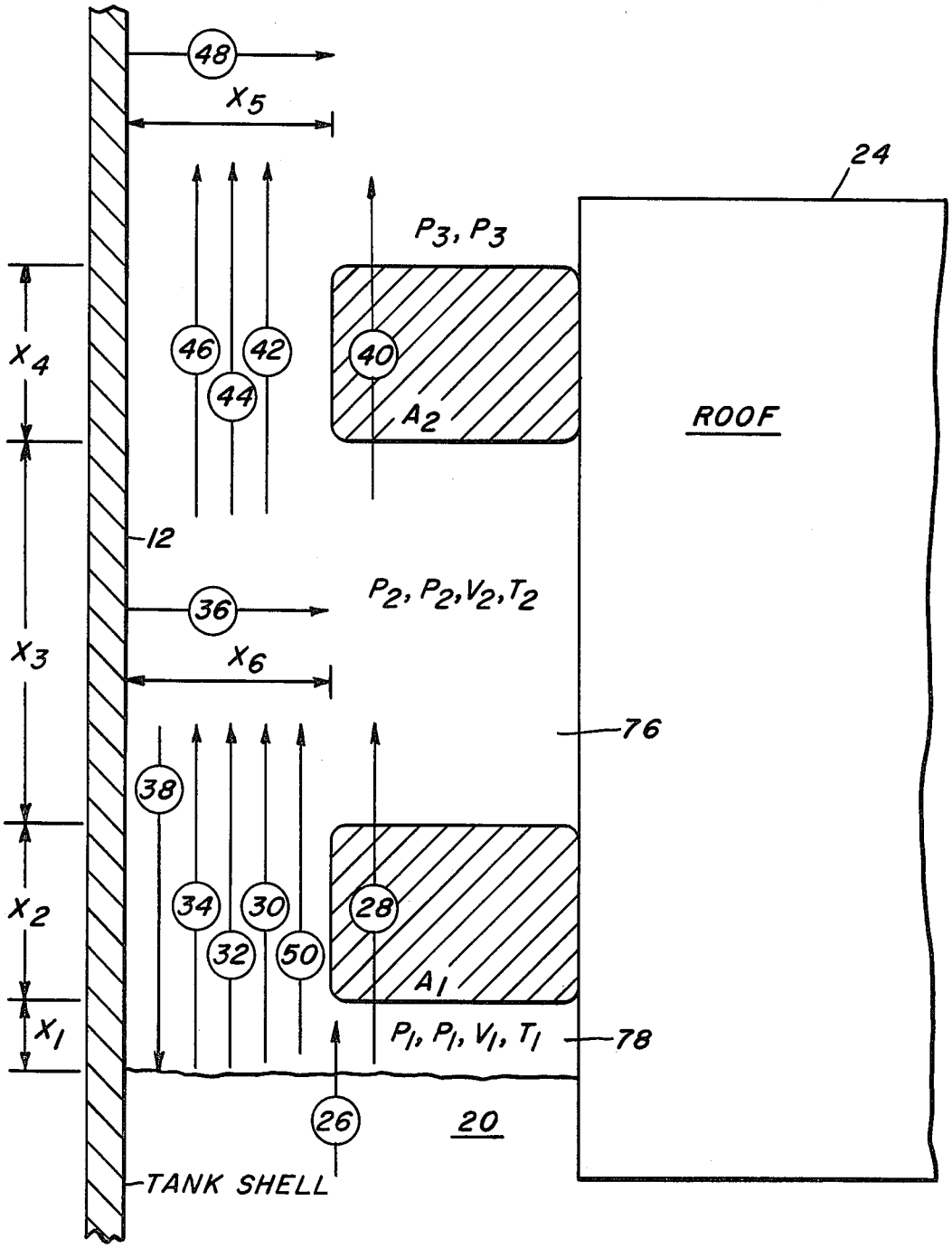
FIG. 2 is a schematic view of a multiple elemented vapor sealing system indicating the various parameters which affect the emission of vapor to the ambient atmosphere.

FIG. 2 illustrates various parameters which have some bearing upon the degree and amount of vapor emissions starting at the liquid 20 which escapes through a sealing system and are passed to the ambient atmosphere. For purposes of simplicity, the multiple seal arrangement contemplated by the present invention has been reduced to a double seal arrangement having two seals $A_1$ and $A_2$ positioned between the tank shell 12 and an outer pontoon 24 of the floating roof 18. The vapor which is resultant from evaporation of the tank liquid 20 is represented by arrow 26 in FIG. 2. The arrow labeled 28 is representative of vapor permeating through the primary seal $A_1$ and passing to the space 76 between the two seals $A_1$ and $A_2$. The vapor which diffuses past the primary seal $A_1$ is represented by the arrow 30, while the hydrocarbon vapor being subject to an induced flow past the primary seal is represented as arrow 32. Induced flow is the amount of vapor flowing past the seal which is caused or is the result of wind eddy currents that cause slight negative pressures above the seal. These flows are minimized in the present invention generally by (1) providing an upper seal with an adequate diffusional path and (2) providing upper and lower seals which allow the flow of vapors in the seal area 76 from points of positive pressure on one side of the tank to points of negative pressure so that "induced" flow past the lower seal is minimized. The amount of liquid which is subject to an upward capillary action through the seal $A_1$ and the tank shell 12 is represented by arrow 34 in much the same manner that vapor resultant from an evaporation of liquid off of the inner surface of tank wall 12 is represented by arrow 36. Arrow 38 is representative of condensation from a saturated vapor space between the two seals which condenses and runs back (as indicated by arrow 38) as a liquid to liquid 20. Arrow 40 represents the vapor permeation through the second seal $A_2$ and arrow 42 represents the vapor diffusion past the second seal $A_2$. Arrows 44 and 46 are representative of the induced vapor flow past the second seal and vapor loss due to diurnal expansion, respectively. Lastly, arrows 48 and 50 represent vapor evaporating from the liquid left on the inner surface of the storage tank above the second seal $A_2$ and vapor emanating from liquid 20 due to diurnal expansion, respectively. Additionally, the characters P, p, V, and T represent (depending upon the respective subscripts) the total pressure, partial vapor pressure, volume and temperature of the volumetric space it is associated with. The remaining characters $X_1$ through $X_6$ represent dimensions between the objects they are associated with as indicated in FIG. 2.

The effects of liquid evaporation due to diurnal contraction are represented via arrows 36 and 48. The liquid evaporation from the inner wall 12 of the tank 10 to the space between the two seals is represented by arrow 36. In a similar manner, the vapor flow due to evaporation from the tank wall 12 above the second seal $A_2$ is indicated by arrow 48. In an opposite manner, the induced vapor flow from diurnal expansion is shown by arrows 46 and 50. The vapor flow past the secondary seal $A_2$ is indicated by arrow 46. In a similar manner, the induced vapor flow from liquid 20 due to diurnal expansion is represented by arrow 50. It should thus be seen that induced vapor flow and evaporation of liquid from the tank wall 12 is produced during both diurnal contraction and diurnal expansion.

Figure 3:
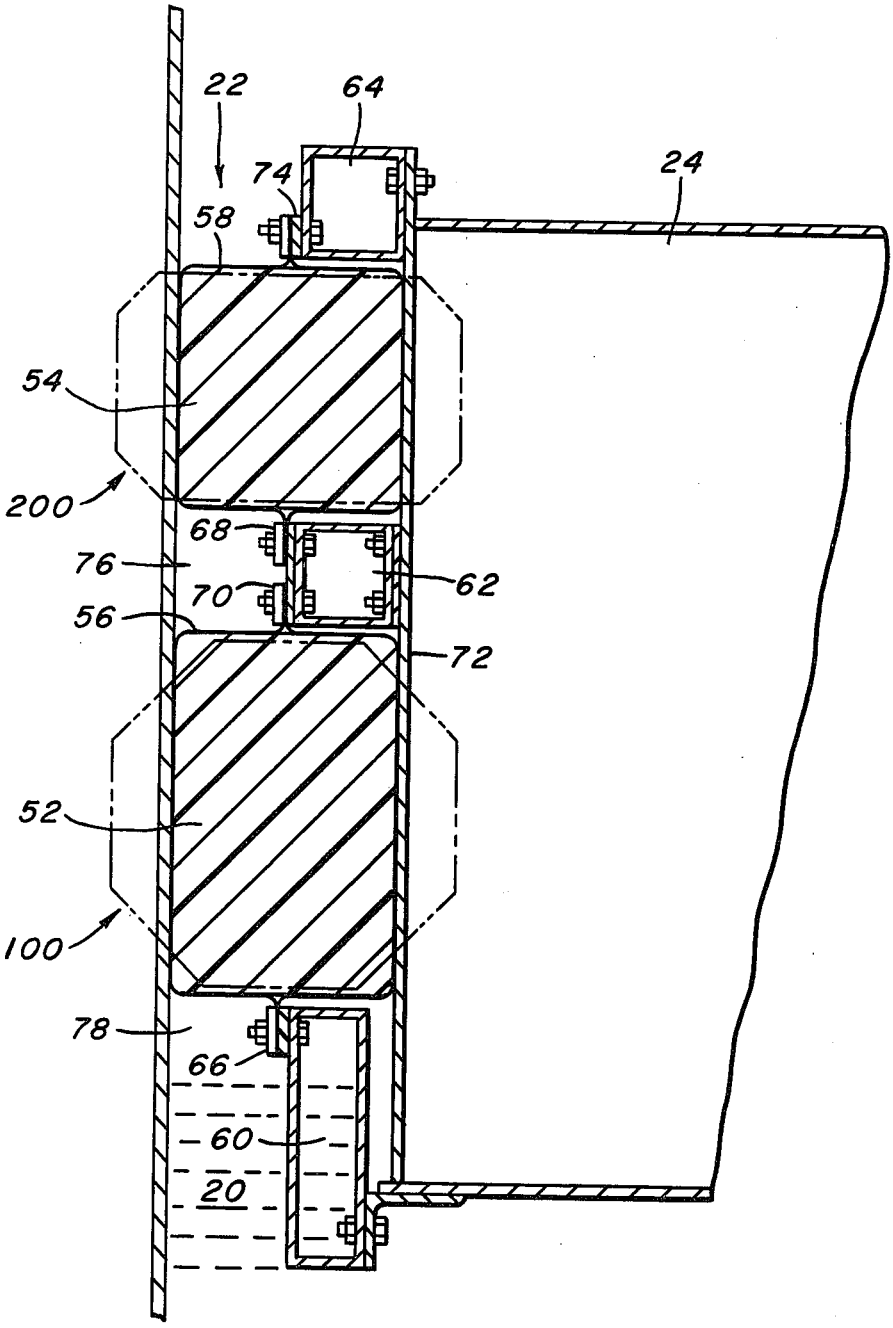
FIG. 3 is a sectional view of one embodiment of the present invention.

FIG. 3 is one preferred embodiment of the present invention which will be discussed both from a specific physical standpoint as well as a theoretical standpoint using the number of parameters noted with regard to FIG. 2. The double sealing arrangement shown in FIG. 3 is constructed from materials presently employed in the floating roof industry. Specifically, two independent octagonal urethane foam logs are provided as at 52 and 54 for forming the lower and upper sealing elements, 100 and 200, respectively, of the multiple sealing arrangement 22. Two wear covers 56 and 58 surround the two urethane logs 52 and 54, respectively, so as to form a relatively impregnable and long lasting first and second sealing elements. The specific nature of the wear cover is well known in the art and will not be further described. The two urethane logs 52 and 54 which make up the first and second seal elements of the sealing arrangement 22 are compressed into their operative position shown in FIG. 3 and are retained at those positions by a plurality of support mechanisms generally indicated at 60, 62, and 64. The support mechanism 60 extends from the lower end of pontoon 24 to a wear cover clamping element 66, located just below the first or primary seal 100. Similarly, a second and third wear cover clamp elements 68 and 70 are provided just above and just below the first seal 100 and the second seal 200, respectively. The supporting mechanism 62 associated therewith functions to retain the two wear cover clamping elements 68 and 70 removed from the outermost portion 72 of the pontoon 24. A fourth wear cover clamping element 74 and its associated supporting mechanism 64 served to retain the wear cover 58 in its operative position shown in FIG. 3. It should be noted that the primary sealing element 100 is retained in an operative position by the supporting elements 60 and 62 just above the liquid level of the hydrocarbon being stored. This specific positioning of the primary element is to substantially reduce the capillary action of the liquid upward about the periphery of the primary seal when the primary seal is in contact with the liquid. This capillary action is substantially reduced by removing the bottom of the primary sealing element 100 from contact with the liquid hydrocarbon, thereby substantially reducing deleterious effects of capillary action as indicated by arrow 34 in FIG. 2. Where it is considered that the deleterious effects of capillary action are outweighed by the effects of increased surface of hydrocarbon liquid exposed in the small vapor space below the bottom seal, the lower seal 100 may be placed in contact with the liquid 20.

Assuming a nonmoving state to the floating roof 18, there is presented a static situation in which a variety of the parameters indicated in FIG. 2 are so reduced as to be negligible. For instance, the evaporation of the liquid off the tank indicated by arrows 36 and 48 is so negligible as to be discounted. Furthermore, the capillary action parameter 34 may be discounted if the primary seal $A_1$ or seal 100 is removed from contact with the liquid 20 in the storage tank 10. For purposes of this discussion, it will be assumed that such is the case. Moreover, if there is no wind or convection current above the roof of the storage tank 10, vapor diffusion past the primary and second seals, and permeation through the seals are the only substantial effects upon escape of vapor from the liquid 20 to the ambient atmosphere. While it is certainly desirable to discount wind and its resultant induced flow of vapor past the primary and secondary seals, it is also realistic to assume that there will be wind and convection currents above the floating roof tank which will have deleterious effects relating to vapor emissions passing to the ambient atmosphere.

With the structure shown in FIGS. 2 and 3 alone, wind above the floating roof will cause turbulence in the area of the second seal 200 ($A_2$ - FIG. 2) and reduce the effective length of the diffusional path of the second seal ($X_4$) as shown in FIG. 2. However, due to the creation of a stagnant air space 76 between the two seals as seen in FIGS. 2 and 3, the wind turbulence above the second seal will not reduce the effective length of the primary seal path created by primary seal 100 ($A_1$ - FIG. 2). This effect may be best seen by referring to FIG. 7.

If a negative pressure is created above the top seal 200 ($A_2$ - FIG. 2) by eddy currents and wind flow, flow of vapor is induced (see arrow 44) past the top seal proportional to the difference in pressure across the seal, i.e., $P_3$-$P_2$. This vapor flow is in addition to the diffusional vapor flow past the upper seal 200 ($A_2$ - FIG. 2). If a uniform negative pressure were to exist across the entire floating roof 18, the effect of a double seal would be reduced inasmuch as a negative pressure might ultimately occur in the vapor space 76 located between the first and second sealing elements, thus inducing vapor flow past the bottom seal. However, this cannot be the case since wind-caused negative pressures would be balanced by wind-caused positive pressures on the opposite side of the tank. Consequently, the pressure $P_2$ in the vapor space 76 would be equalized about the periphery of the seal and remains in approximately equal pressure to the pressure $P_1$ below the bottom seal within vapor space 78. Thus, diffusional vapor flow past the bottom sealing element 100 plus permeation through the bottom seal 100 remains the limiting factors.

Another factor which has large bearing upon the amount of vapor emitted to the ambient atmosphere regards evaporation of liquid from the inner surface of the storage tank during descending movement of the floating roof 18. The reasons for the descension of the floating roof 18 during normal operating procedures relates primarily to an unloading operation in which liquid is drained from the tank, thereby causing the floating roof 18 and the related sealing components to move downwardly with the liquid level and secondly, the natural phenomenon relating to tank breathing or diurnal expansion and contraction of the liquid. Diurnal expansion and contraction generally relate to the increase and decrease of the ambient surrounding temperature and consequently, of the volume of the liquid 20 stored within the storage tank 10. During the daylight hours, the liquid 20 within the storage tank heats up and expands, thereby causing the floating roof to rise along with the liquid level. However, during the night when radiational cooling takes effect the liquid 20 within the storage tank 10 cools and accordingly contracts thereby dropping the liquid level and the floating roof 18. Whatever the cause for descension of the floating roof 18, there exists a phenomenon which causes substantial vapor emission to the ambient atmosphere. As the floating roof 18 lowers, liquid is left on the inner surface of the tank wall 12. Some of this liquid runs down the inner surface back into the tank. However, the remaining liquid left on the inner surface of the tank after passage of the top seal 200 ($A_2$ - FIG. 2) tends to evaporate and vaporize to the ambient atmosphere causing pollution and waste of material. The effects on this vaporization indicated at line 48 in FIG. 2 is not insubstantial, and, in fact, has been determined by applicants to be of major proportions.

In order to eliminate, or at least drastically reduce, the effect of evaporation from the inner surface of the storage tank to the atmosphere, as indicated by arrow 48 in FIG. 2, the multiple sealing arrangement as shown in FIGS. 2 and 3 is provided. In operation, the floating roof 18 descends as the liquid 20 is withdrawn from the tank 10 or is subject to diurnal contraction. During this process, a given amount of liquid 20 is left on the inner surface of the storage tank 10. Due to the fact that the primary seal 100 is not in contact with the liquid 20, it acts as a wiper during the descent of the floating roof for removing at least a portion of the liquid remaining in the inner surface of the storage tank. Similarly, upper seal 200 is operative to wipe off most of the liquid that has not evaporated from the tank wall to the vapor space 76 provided between the two seals 100 and 200 or which has not run back into tank 10. It should be emphasized that the sealing arrangement of the present invention is so configured that the distance $X_3$ (see FIG. 2), representative of the distance between the first and second seals, is equal to at least an average rate of descent for the loading roof under normal operating circumstances multiplied by the amount of time required for substantially all of the liquid left on the tank wall to evaporate into the seal area space 76. A vast majority of the liquid remaining on the inner surface of the tank wall will run back into tank 10 as indicated by arrow 38 in FIG. 2. Additionally, due to the separation of the two sealing elements, the liquid remaining on the tank wall which evaporates (if nonsaturation conditions exist), will do so, to a large degree, within the vapor space 76. Without exception, sealing arrangements of the prior art noted above cannot contain the evaporated liquid within the vapor space due to the lack of any vapor retaining second seal above the primary seal. The seals above the primary seal act primarily as weather shields and little more. Consequently, in these cases, the liquid evaporating from the inner surface of the storage tank 10 would be permitted to pass by the weather shield directly to the ambient atmosphere.

The rate of evaporation of liquid from the inner surface of the storage tank to the vapor space 76, as well as the amount of liquid left on the inner surface of the storage tank, will be a function of the specific nature of the liquid, its gravity, its viscosity, and the surface tension of the fluid 20 being contained within the storage tank 10. Consequently, it is almost impossible to specifically detail what the distance between the two seals will be for each and every case. However, it is possible to calculate within certain reasonable limitations the maximum distance $X_3$ necessary in order to accommodate the majority of evaporations from the tank wall to the ambient atmosphere as indicated by arrow 48 in FIG. 2. Throughout the discussion of the current embodiment, as well as the further embodiments which will be discussed below, it is assumed that the separation $X_3$ of the two sealing elements 100 and 200 is sufficient, for practical purposes, to accommodate a large proportion of the liquid evaporating into the vapor space 76 provided therebetween. The distance ($X_3$) between the two sealing elements sufficient to capture the majority of the evaporable hydrocarbon liquid left on the tank wall as the roof descends can be approximated as follows:

a. By field or laboratory observations determine the amount of material (weight) which initially clings to a unit area of tank wall surface at storage temperature.

b. By analysis and equilibrium flash calculations determine the composition of vapors in normal equilibrium with the liquid under the temperatures of storage and the atmosphere pressure of the installation.

c. Calculate the latent heat of vaporization of the calculated vapor composition.

d. Determine the specific heat of the liquid phase.

e. Determine (from design of the system) the maximum rate of roof descent in feet per hour.

f. Calculate the heat transfer coefficient for transfer of heat from the tank wall to the liquid film and through the thickness of the film.

g. Calculate the instantaneous lowering of the seal area surface temperature of the film by use of the latent heat of the vaporized material and the specific heat of the remaining liquid.

h. Calculate the heat transferred per unit of roof descent.

i. Calculate seal spacing necessary to expose enough surface to accomplish complete vaporization between the seals.

It should be emphasized that the seal separation is meant to accommodate and capture the evaporation of the majority of the evaporable hydrocarbon liquid left on the tank wall as the roof descends. Certainly, there is some of such liquid which is not evaporable and which will either run down the tank wall to the stored liquid or remain on the tank wall.

As previously noted, the effects of wind and wind eddying cannot be discounted and, in fact, have a large bearing upon vapor losses. If there is no wind to create areas of negative pressure and thus induced flow past the top seal 200, the two seals essentially act as one with a diffusional path length equal to the sum of $X_2$ through $X_4$. Initially, hydrocarbons diffuse, permeate, and vaporize into the vapor space 76. At the same time, hydrocarbons diffuse and permeate past and through the top seal 200. As the vapor surface 76 becomes saturated, the flow into this space tends to reduce and the flow of hydrocarbons out tends to increase until an equilibrium has been established. At that point, the two seals are both effective. If flows are induced past the top seal 200 by wind action (see arrow 44) the concentration of hydrocarbons in the vapor space 76 would be reduced since the rate of diffusion and permeation into the space 7 would not be increased. Thus, diffusion and permeation past and through the bottom seal 100 would govern unless at that time there were vaporable hydrocarbons on the shell. In that case, the vapor space 76 would remain saturated and the induced flow past the top seal would, in fact, cause a flow in excess of the sum of diffusion past and permeation through the bottom seal 100. However, there cannot be a wind-induced flow past the bottom seal since pressures will be equalized from one side of the tank to the other. The cross-sectional area of the vapor space 76 must be sufficient to assure laminar flow within the space 76 from one side of the tank 10 to the other. Even if wind should not happen to cause a negative pressure, and an induced flow across the top seal 200, it may still reduce the effectiveness of that top seal with respect to diffusional flow by causing turbulence in the seal gap (see FIG. 7). It is essential in this regard that the wind effects be confined to the top seal only. There must be a substantially stagnant area between the seals to protect the integrity of the diffusional path length of the bottom seal 100.

The removal of the bottom seal 100 from contact with the liquid 20, in order to minimize the capillary action between the bottom seal 100 and the tank shell 12, creates a lower vapor space 78. This space 78 will vary in size depending upon the gravity of the liquid being contained, and hence the buoyancy of the floating roof. However, the vapor space 78 should be kept to a minimum consistent with maintaining a vapor gap between the liquid and the bottom of the bottom seal 100. This space and its maximized qualities, for a given liquid being stored, will be specifically considered in the tank design.

As the previous discussion indicates, it is necessary, for efficient sealing of the storage tank that the upper seal 200 ($A_2$ - FIG. 2) be of a vapor sealing efficiency as is the primary or first seal 100 ($A_1$ - FIG. 2). For instance, if the sealing efficiency of the second seal 200 were not of effective sealing efficiency (as is found in the prior art "secondary seals"), any vapor escaping past the lower seal), or liquid which is left on the tank shell and which evaporates, would be expelled into the atmosphere. Moreover, in order to provide for a more likely vapor saturation state within the vapor space 76, the vapor space 76 is minimized to volumetrically so as to decrease the amount of vapor within the space provided between the two sealing elements while keeping the seals separated a sufficient amount to contain evaporating during any downward movement of the tank roof. As such, vapor within the space 76 has a better chance of reaching a saturation state earlier, in which case it will condense and run back into the storage tank 10.

Figure 4:
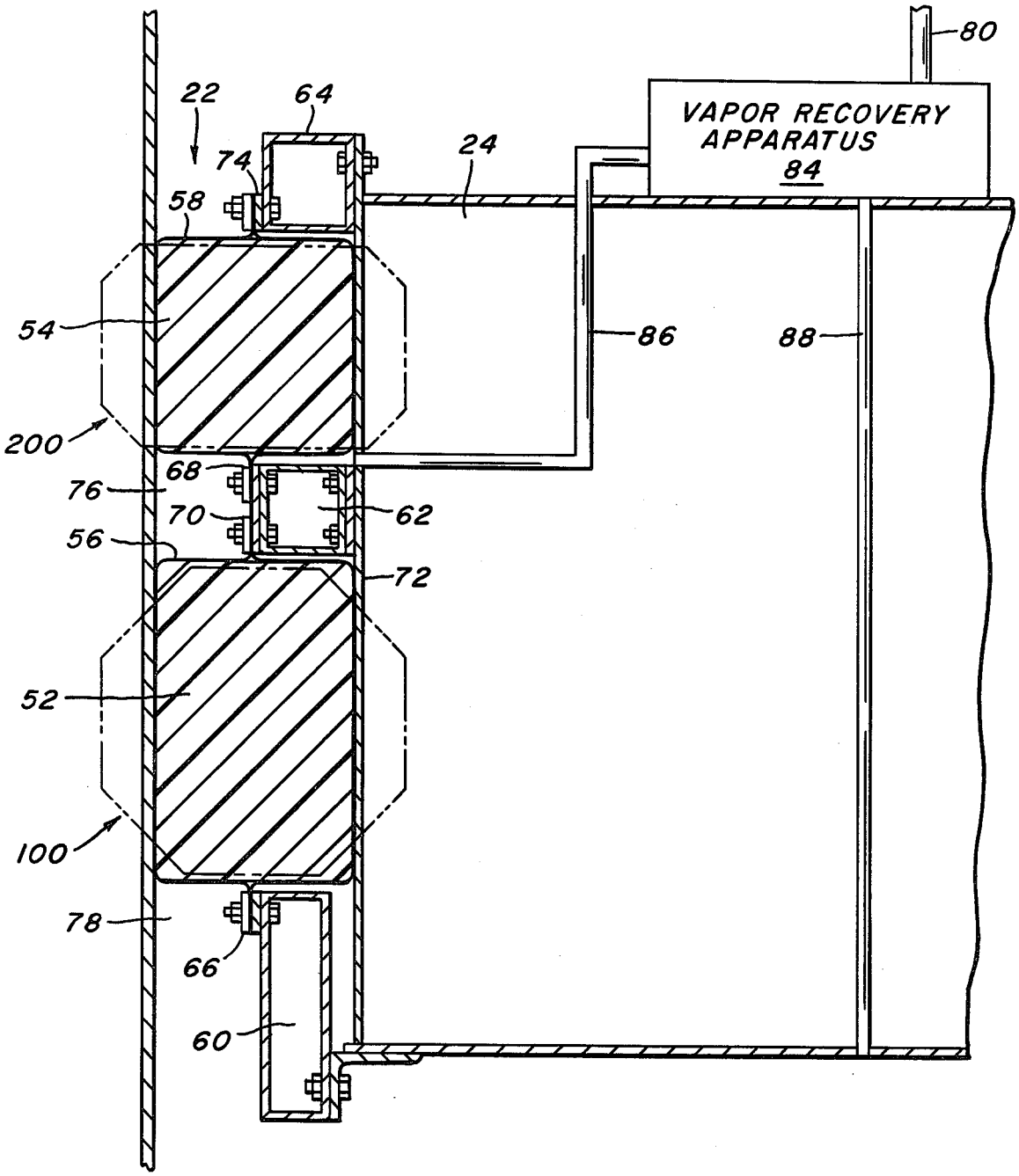
FIG. 4 is a sectional view of a second embodiment of the present invention.

In an attempt to maximize the efficiency of a sealing system which remains economically practical, the applicants have provided for a number of different embodiments which reduce a number of the vapor emission parameters indicated in FIG. 2. For instance, FIG. 4 shows a sealing system similar to that shown in FIG. 3 with the addition of a slight negative pressure being created in the sealing area 76 between the first and second seals 100 and 200, respectively. By means of a vapor recovery apparatus 84 and a connected return line 88, a system is created which carries vapors away from the space 76 via appropriate tuning, as at 86, condenses them and returns hydrocarbons back to the liquid storage area. An air vent 80 is provided for permitting escape of any air recovered. Such systems are currently available and represent the state of the art. The negative pressure created within the vapor space 76 will increase vapor diffusion and permeation losses through the primary seal 100 by creating a slight negative pressure differential between vapor spaces 78 and 76, but in total, the hydrocarbon losses through the system as a whole can be reduced to a very low value. The only losses which might occur would be vaporization from liquid clinging to the inner surface of the storage tank subsequent to passage of the top seal 200, a situation which, due to the configuration of the sealing system 22, would be minimized.

Figure 5:
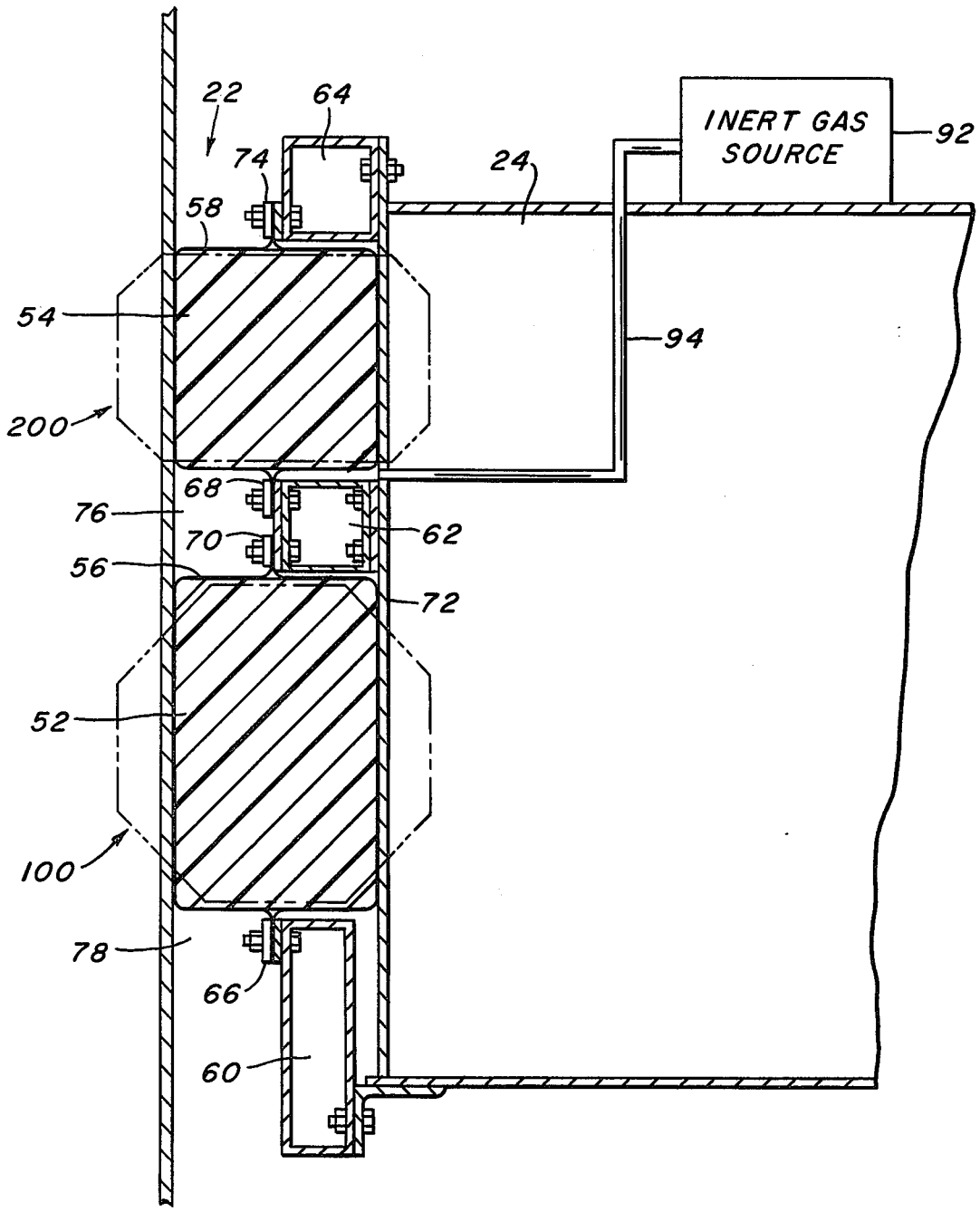
FIG. 5 is a sectional view of a third embodiment of the present invention.
Figure 11B:
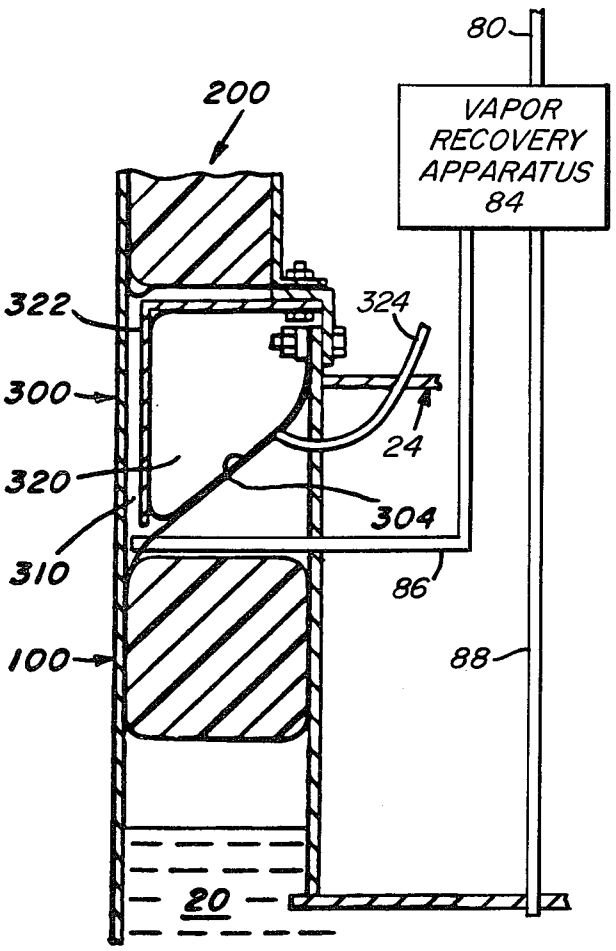
FIG. 11*b* is another sectional view of yet a further embodiment according to the present invention.
Figure 11A:
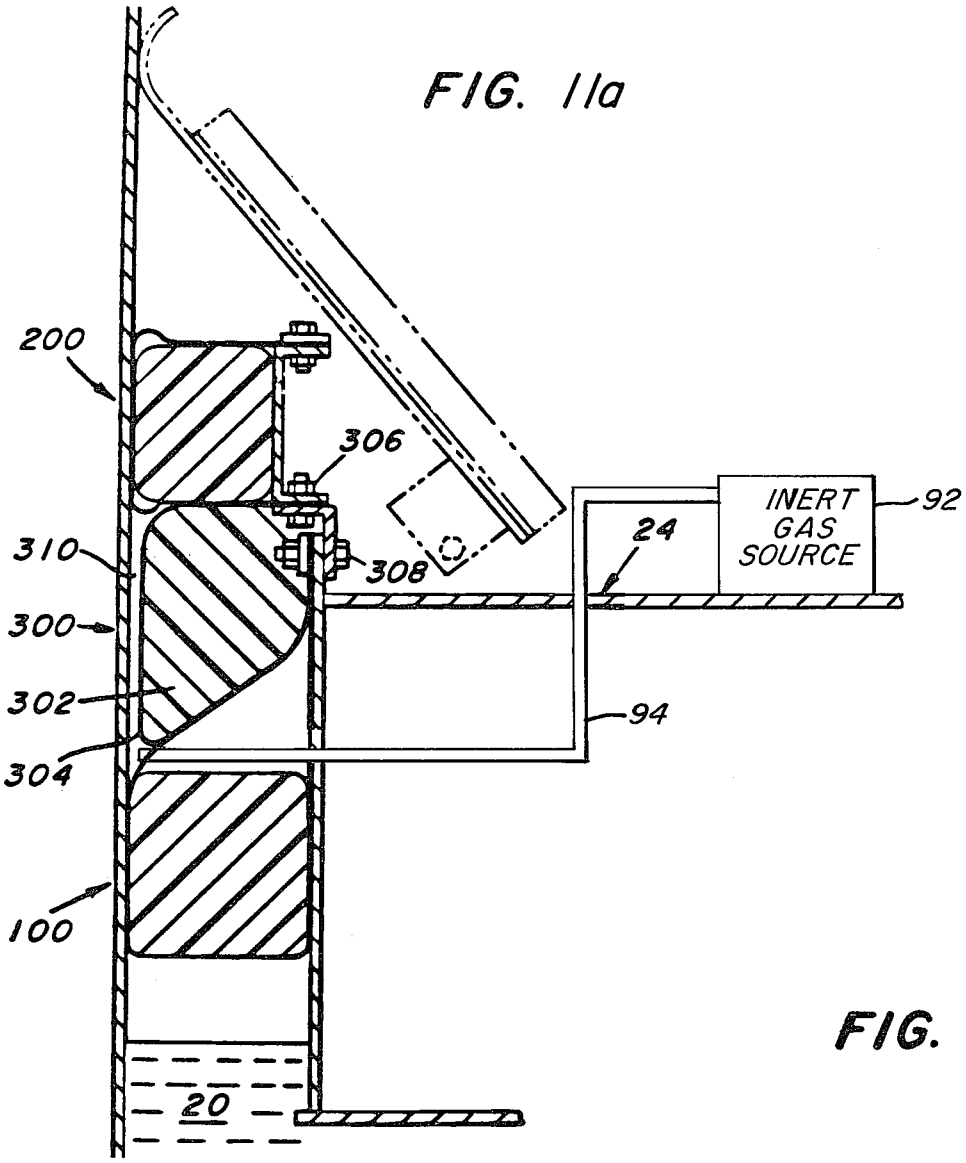
FIG. 11*a* is a sectional view of a further embodiment according to the present invention.

A second alternative sealing arrangement is indicated in FIGS. 5 and 11*a* in which an inert gas source 92 may be connected to the vapor space 76 through appropriate piping 94 to create a small positive pressure in the sealing area 76. This increased pressure will reduce permeation and diffusion vapor losses and thus reduce total hydrocarbon emissions. Such a system will not, however, affect losses due to evaporation of liquid from the inner surface of the storage tank due to diurnal contraction and/or unloading procedures. Moreover, the provision for an inert gas filled space reduces any fire or explosion hazard in the seal area.

Figure 6:
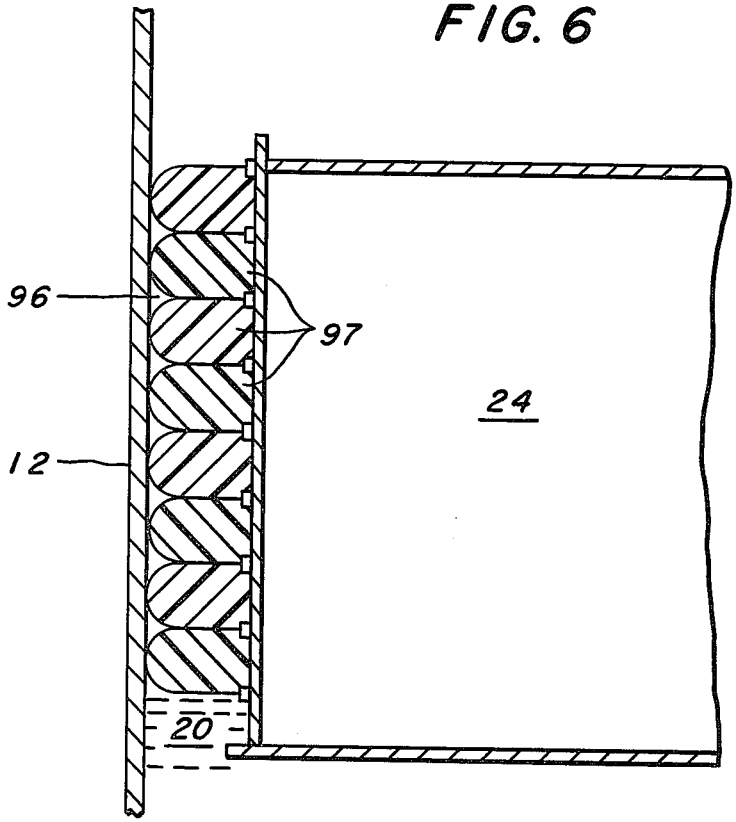
FIG. 6 is a sectional view of another embodiment of the present invention.

Still another alternate embodiment is shown in FIGS. 6 and 11*b*. A relatively large plurality of sealing elements 97, functionally independent of one another and separated by a vapor space such as at 96, are provided between the pontoon 24 and the tank wall 12. As indicated previously, the larger the diffusion path, the greater the efficiency of a vapor seal. Moreover, the plurality of seals will further reduce emissions by even more improved wiping of the tank wall 12. Consequently, a large plurality of vapor seals provided between the liquid 20 and the ambient atmosphere will, in effect, drastically reduce vapor emissions to the ambient atmosphere. It should be noted, however, that systems exemplary of those shown in FIG. 6, while of the highest technical efficacy, are probably not economically practical and might only be included in situations where infinitesimal vapor emissions might be tolerated.

Figure 7:
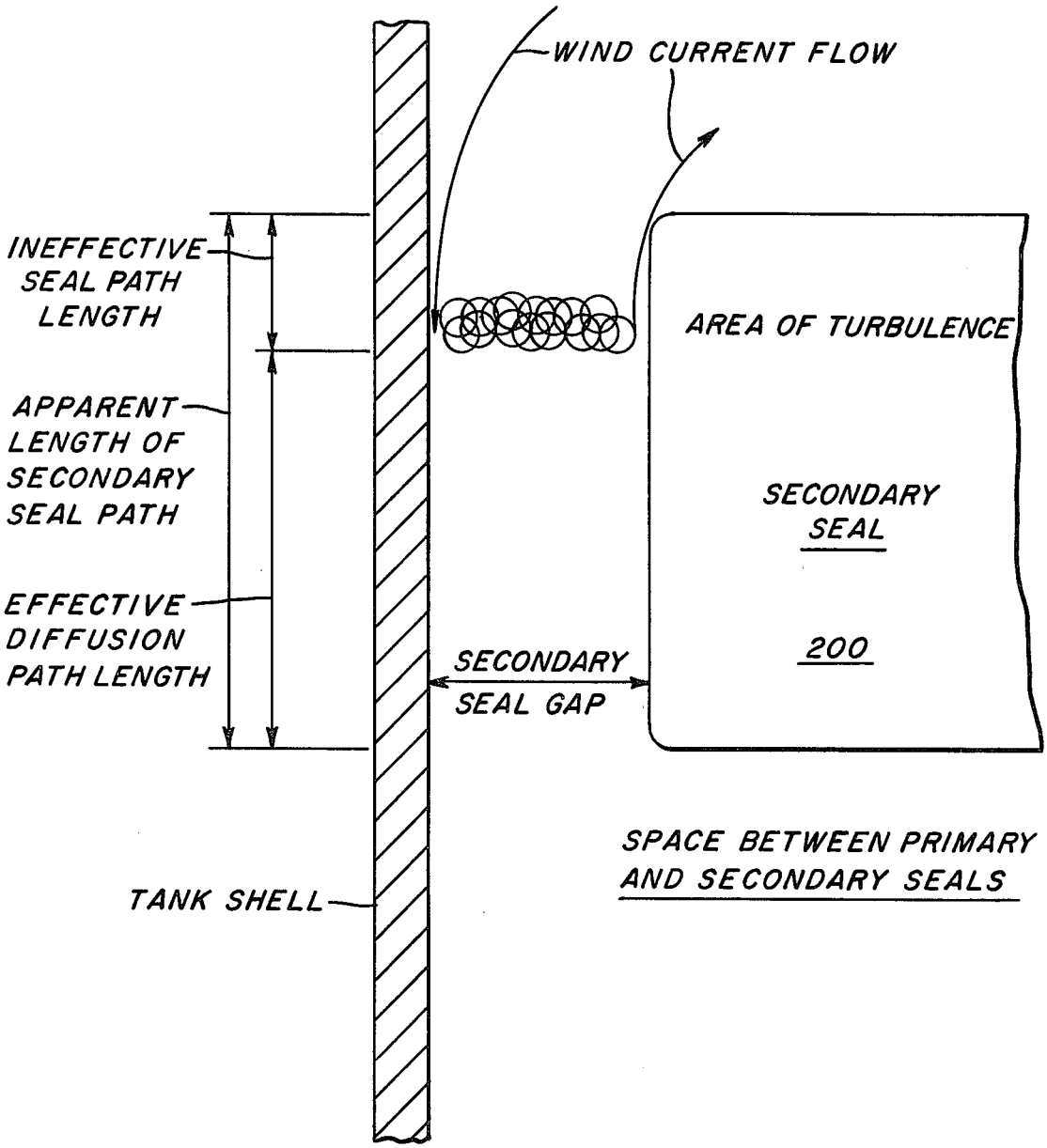
FIG. 7 is a schematic view of one portion of the present invention indicating reduction of effective diffusion path due to wind turbulence.
Figure 8:
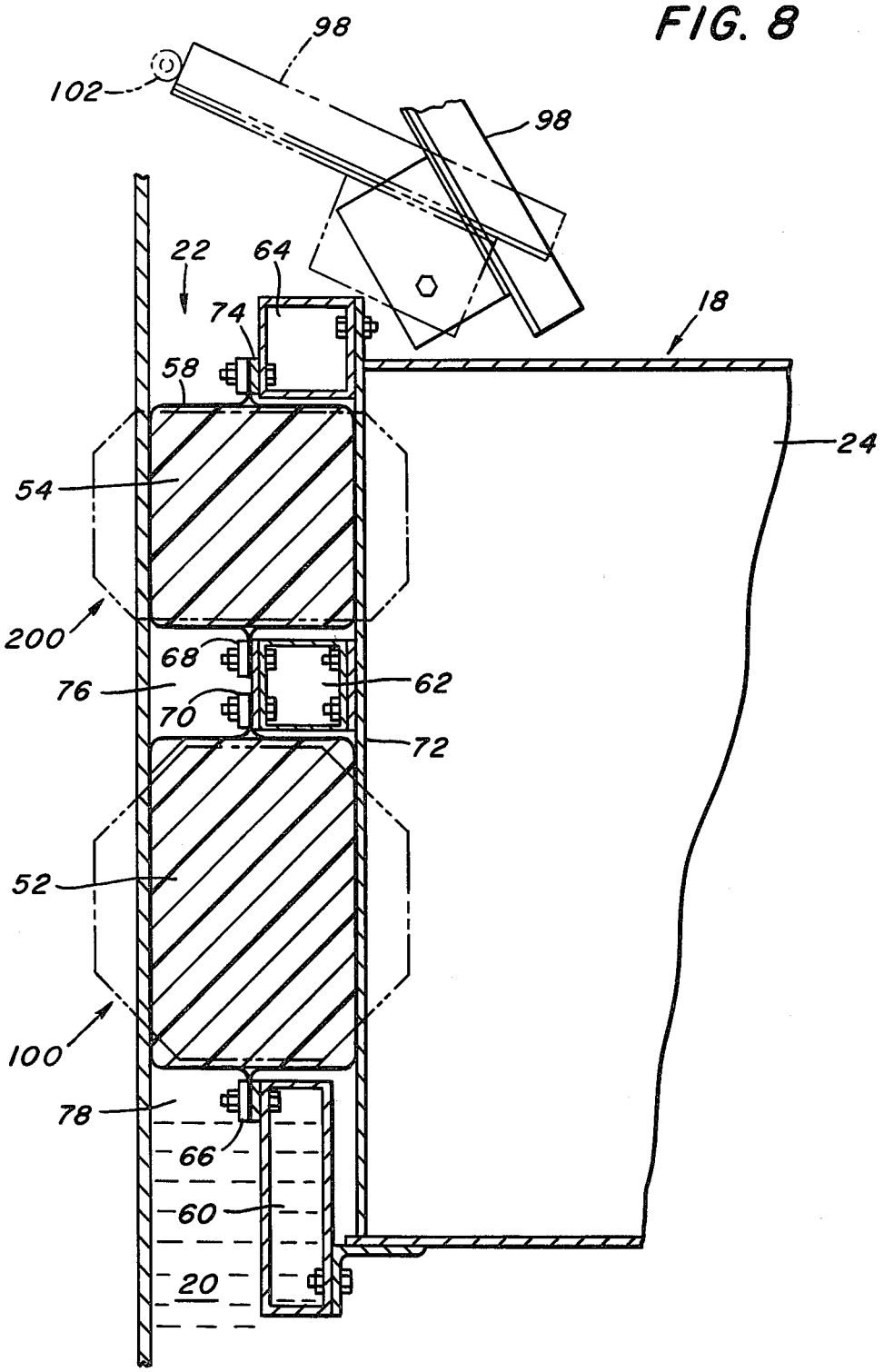
FIG. 8 is yet another embodiment of the present invention.

In order to maximize the effective diffusion path length of the top seal shown in FIG. 7, and to shield the sealing arrangement from the weather, an alternative embodiment is provided. As shown in FIG. 8, a standard weather shield is provided in addition to the multiple sealing arrangement 22 for slightly increasing the effective diffusion path length of the second seal 200 to its full apparent length. Additionally, the standard weather shield prevents the entrance of precipitation and any other foreign matter from entering the sealing arrangement and possibly contaminating the liquid stored within the storage tank 10. The weather shield indicated at 98 is pivotally attached to a top portion of the floating roof 18 and is movable between the two positions shown in FIG. 8 for accommodating upward as well as downward movement of the floating roof. The upper portion of the weather shield includes a scraper portion 102 which is in slideable contact with the inner surface of the storage tank as is well known in the art. Precipitation and foreign matter running down the weather shield 98 is collected at the center of the storage tank 10 and is channeled to the exterior of the tank through any appropriate convenient means. It should be noted that weather seals do not provide the necessary wind insulative effects produced by the second seal of the present invention. However, the addition of a weather seal in combination with the multiple sealing arrangement of the present invention permits for introduction of a second seal 200 of a somewhat smaller vertical sealing path length than that necessary in the absence of a weather shield. In such an absence, the second seal 200 would be optimally configured having an increased vertical seal path length in order to provide for a certain ineffective seal path length due to the area of air turbulence shown in FIG. 7. It is important for high sealing efficiency, as explained above, that both the first seal 100 and the second seal 200 be of effective vapor sealing efficiencies. The sealing efficiency of the second seal 200 may be somewhat greater than that of the first seal, but should be of substantially lesser sealing efficiency.

The importance of the efficiency of the second seal in the present invention bears some repetition. In point, the secondary weather seals of the prior art merely keep the elements from attacking the primary seal. In this operation they do very well. However, they do not operate effectively to provide a stagnant space between the two seals to reduce the diffusional and evaporative emissions from the liquid and seal space. As such, they fail to act as a second diffusion seal.

Figure 9:
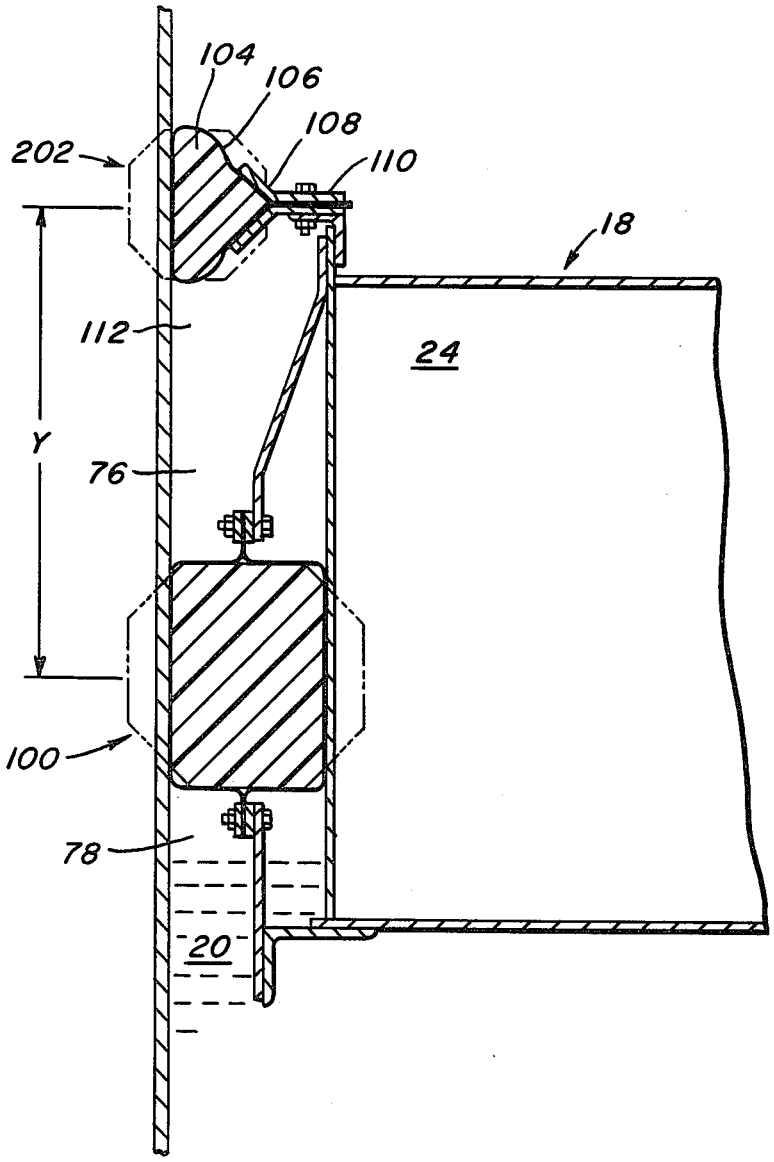
FIG. 9 is yet another sectional view of a further embodiment according to the present invention.

Yet another embodiment of the present invention shown in FIG. 9 illustrates the fact that the first and second seals 100 and 200, respectively, need not be of similar design but only of similar sealing efficiency. Specifically, the primary seal 100 of FIG. 9 is configured in much the same way as the primary seal disclosed in FIGS. 3, 4, 5 and 8. However, it will be noted that the second seal 202 of the embodiment shown in FIG. 9 is not shaped similarly to those shown in the corresponding figures noted below but has a different configuration. It is important to note that the second seal 202 of the alternative embodiment shown in FIG. 9 is not what is commonly referred to as a weather seal or "secondary seal" due to its vertical length of sealing contact with the inner surface of the storage tank. The second seal 202 is effective as a diffusion seal and has a sealing efficiency approximately equal to that of the first sealing element 100. The second seal 202 is formed from an octagonally shaped urethane foam log 104 having a wear resistant seal cover 106 surrounding it. The second seal 202 is supported by a generally right-angle bracket 108 which is connected to the top portion 110 of the pontoon 24 as shown in FIG. 9. In much the same manner as the embodiments described below, the first seal 100 and second seal 202 are separated from each other a distance Y which is sufficient to accommodate the evaporation of liquid left on the inner surface of the tank wall during descension of the floating roof and promote runback of material left on the inner surface of the tank wall. Again, there is a specific intent to minimize the volumetric space 112 between the two seals so as to provide an easily saturated vapor space for decreasing vapor diffusional losses through the sealing arrangement.

Figure 10A:
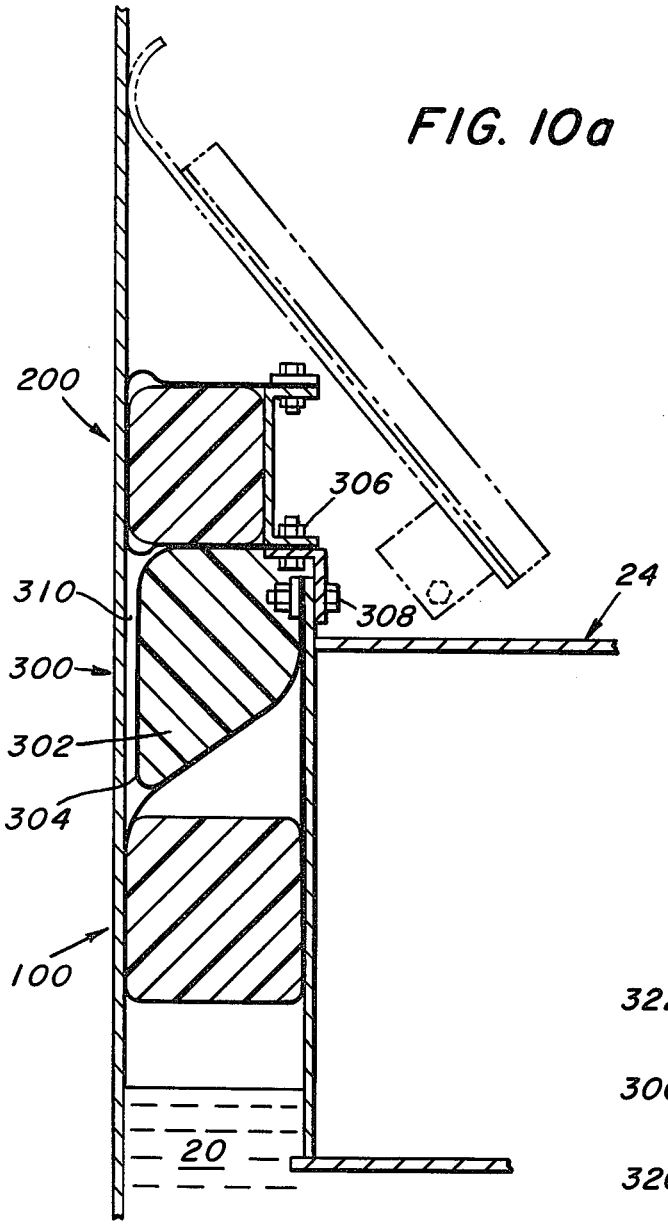
FIG. 10a is another sectional view of a further embodiment according to the present invention.
Figure 10B:
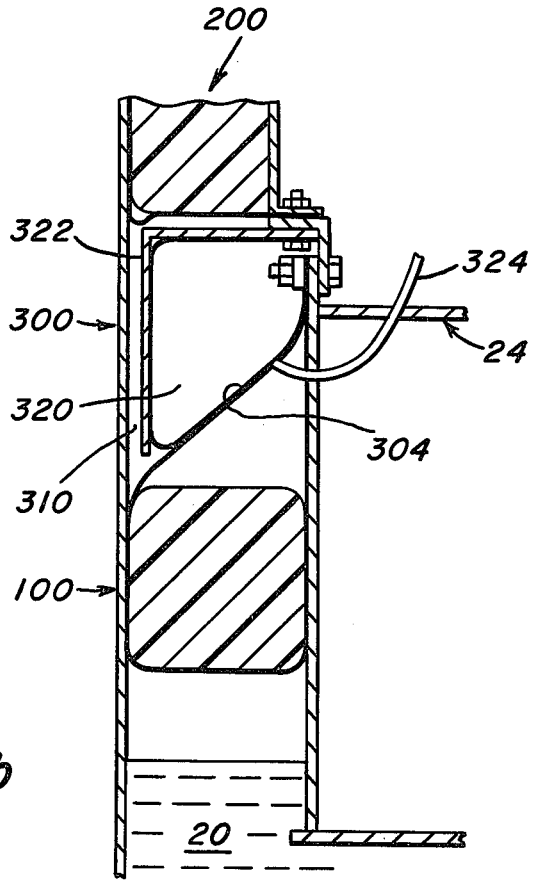
FIG. 10b is a portion of the apparatus of FIG. 10a with an additonal embodiment added.

Several alternative seal configurations to reduce the volume between the primary and secondary sealing elements may be best evidenced by referring to FIGS. 10*a* and 10*b*. FIG. 10*a* represents one embodiment of a roof sealing arrangement according to the present invention in which a volume reduction element 300 is placed within the space provided between the two seals 100 and 200 as shown. Inasmuch as a variety of factors have direct bearing upon what circumstances space minimization may be accomplished, it should be noted that the minimization of space between the primary and secondary seals is a theoretically desired result for the embodiments discussed but is actually achieved in a representative manner only with respect to FIGS. 10*a* and 10*b* as well as FIGS. 11*a* and 11*b*.

The volume reduction element 300 is a single ring element placed between the two seals (or more — see FIG. 6 for instance) about the total periphery of the annular space between the floating roof 24 and tank wall 12. Element 300 may take any one of a number of convenient and efficient configurations available so long as it decreases the volume between the seals without interfering with their diffusional sealing and wiping functions. One embodiment of element 300 is shown in FIG. 10*a* and 11*a*. As indicated in that Figure, an additional urethane log 302, covered by a wear cover 304, is attached by bolts and clamps to the floating roof 24. Both the method of attachment of the wear cover 304 and log 302 to the floating roof 24 as well as the make-up of the log 302 and the cover 304 are similar to those described above. One end of the wear cover 304 is held by the bolting assembly 306 for the upper seal 200, while the other end is retained by the bolting assembly 308 for the lower or primary seal 100. Both the urethane log 302 and the wear cover 304 are, as previously noted, conventional in their make-up. The exact configuration of the two, however, is not conventional inasmuch a they are specifically configured to reduce, if not to minimize, the volume previously existent between the primary seal 100 and the secondary seal 200. The log 302 is characterized in having a shape which is substantially similar to the volume it is placed in. This may be accomplished by conforming the log's shape to the volume prior to the sealing arrangement's assembly or by forming the log to the volume through the use of foams and the like which are inserted within the wear cover and subsequently "harden" to the desired shape.

Regardless of the manner of formation of the log and its assembly into the double sealing arrangement, it is important that the log and associated wear cover not interfere with the functioning of the seals. In order to accomplish this, the volume reducing element is configured to fit rather closely to the shapes of the upper and lower seals in all areas except along the tank wall. In this area the log is foreshortened to leave a small elongated area 310 which is small enough to become easily saturated with hydrocarbon fumes for effecting greater runback and for creating a smaller space which is evacuated of such fumes due to pressure differentials during periods of wind. Additionally the space is large enough for retaining the individual and independent nature of both seals for reasons previously explained.

FIG. 10*b*, which is a detailed view of one portion of the apparatus of FIG. 10*a*, represents an additional embodiment of the arrangement shown in FIG. 10*a* in which an air bag 320 is located between the two seals which may be filled with air or other gases as well as foam to conform to the volume. A limiting element 322 is attached to the seal arrangement supporting assembly (by conventional means) for limiting the outward extent of movement of the bag toward the tank wall when the bag is filled with the aforementioned air, gas or foam. A filling tube 324 is connected to the bag for filling or emptying purposes and extends through the floating roof to the top thereof.

The volume reducing element, in whatever configuration it may take, is operative to reduce the amount of hydrocarbons within the space between the two sealing elements which, of necessity, must be separated for the reasons stated above. The smaller the volume between the two seals, the more easily saturated the space will become with smaller quantities of hydrocarbon fumes. When so saturated, the space or volume then begins to "reject" the further evaporation of hydrocarbon liquid being stored. Additionally, the smaller the space, the less hydrocarbon gases will be susceptible to evacuation by wind currents and eddying discussed previously. The smaller volume also increases the "runback" of condensed liquids to the stored hydrocarbon liquid, thereby reducing emissions to the atmosphere.

The sealing arrangement of the present invention is operative to drastically increase the efficiency of sealing mechanisms for floating roof tanks. The multiple sealing arrangement of the present invention employs a plurality of diffusion seals having substantially equal efficiencies and having strategically configured spaces provided therebetween for containing vapor to a point where it becomes saturated, thereby promoting the runback and return of any further input to the tank as liquid. The specific configuration of the two or more sealing elements, their distance from one another, and the minimized volume presented between the two provides for a system having a relatively large vertical sealing length for accommodating a large proportion of the vapor resulting from evaporation of liquid left on the inner surface of the storage tank during diurnal contraction and/or liquid unloadings as well as a decrease in the volume of such spaces for reducing diffusional and permeation vapor losses. In this regard, the large vertical sealing elements occasionally found in the prior art fail. The inefficiency of prior systems for sealing the annular between floating roofs and inner surfaces of storage tank 10 is underscored by the fact that applicants have determined a 90% reduction in vapor emissions through use of the present multiple seal arrangement to be possible as compared with sealing arrangements currently available. Applicant's invention has the added advantage of a simplicity of parts and therefore costs, and a retention of the precious liquid being stored within the tank rather than its subsequent loss by evaporation. It should become apparent, however, that the greatest advantage could be realized by the present invention is the greatly reduced amount of hydrocarbon emissions to the ambient atmosphere which both pollute our cities and create fire hazards which have resulted in explosions and losses of life.

While certain changes may be made in the above noted apparatus, without departing from the scope of the invention herein involved, it is intended that all matter contained in the above description, or shown in the accompanying drawings, shall be interpreted as illustrative and not in a limited sense.

We claim:

1. A low emission sealing arrangement adapted for use in a liquid storage tank of the variety having a floating roof of a diameter slightly less than the diameter of such tank, said sealing arrangement sealing the annular space between the floating roof and the inner surface of such storage tank to prevent the loss of at least a portion of such liquid by vaporization, said sealing arrangement comprising:

a plurality of functionally independent, effective vapor sealing and substantially vertically spaced diffusional sealing elements attachable to such floating roof and being in substantially constant slideable engagement with such inner surface of such storage tank for sealing the space between the floating roof and the inner surface of such storage tank, each of said sealing elements providing a seal between such inner surface of said storage tank and such floating roof, said sealing elements being separated for providing at least one stagnant space located therebetween for protecting the integrity of the diffusional path length of the sealing elements located therebelow and confining the effects of wind and wind eddying to the upper sealing elements, said sealing arrangement having a total vertical dimension sufficient to contain a large proportion of the evaporation of any liquid left on the inner surface of such storage tank during normal diurnal and unloading descension of such floating roof within such storage tank;

means for reducing the volume between successive sealing elements for creating a more easily saturated space therebetween; and means for supporting said plurality of vertically spaced sealing elements upon such floating roof in a sealed relationship thereto.

2. The sealing arrangement of claim 1 in which said sealing arrangement further includes means for evacuating the spaces provided between successive sealing means for capturing vapors located therein, whereby vapor emitting from such storage tank is reduced.

3. The sealing arrangement of claim 1 in which said sealing arrangement further includes means for at least partially filling at least one of the spaces provided between successive sealing elements with an inert gas for reducing vapor diffusion through said sealing arrangement.

4. The sealing arrangement of claim 1 further including a weather seal member pivotally attached to such floating roof above said plurality of sealing elements for protecting at least the uppermost one of said sealing elements from the ambient elements including efficiency reducing wind drafts and for preventing substantial amounts of precipitation from entering the storage tank through said sealing arrangement.

5. The sealing arrangement of claim 1 in which the lowermost sealing element of said plurality of sealing elements is attached to such floating roof such that it is supported in sealing association with tank and is not in contact with such liquid, thereby reducing the upward capillary action effect of such liquid upon said sealing element.

6. The sealing arrangement of claim 1 in which the vertical distance between the lowermost sealing element and at least one other upwardly removed sealing element of said plurality of sealing elements for a given liquid being stored is equal to or greater than the maximum normal rate of descent of such floating roof, as a result of diurnal contraction or liquid unloading, multiplied by the time necessary for a large proportion of the evaporable liquid residing on the inner surface of the storage tank to evaporate, whereby substantially all of such vapor is captured within the confines of said sealing arrangement.

7. The sealing arrangement of claim 6 in which at least one of said sealing element functions both as a diffusion seal and a wiping element for wiping off at least some of the liquid remaining on the inner surface of such storage tank during descension of such floating roof such that substantially all of the evaporable liquid remaining subsequent thereto will evaporate within the confines of said sealing arrangement.

8. The sealing arrangement of claim 1 in which each of said sealing elements is configured having a generally toroidal shape, and vertical length of sealing contact of each of said sealing elements with such inner surface of such storage tank being approximately equal to the radial distance between such floating roof and such inner surface.

9. A low emission sealing arrangement for a liquid hydrocarbon storage tank of the variety having a floating roof of a diameter slightly less than the diameter of such tank, said sealing arrangement comprising:

first diffusional sealing means, attachable to a portion of the floating roof so as to be in substantially continuous slideable engagement with the inner surface of such storage tank for diffusionally sealing the space between the floating roof and such inner surface;

second diffusional sealing means attachable to the floating roof, said second sealing means being in substantially continuous slideable engagement with such inner surface of such storage tank for diffusionally sealing the annular space between the floating roof and such inner surface, said first and second sealing means being of effective vapor sealing efficiencies for reducing diffusion past said sealing arrangement, said first and second sealing means being so arranged relative to the floating roof, the inner surface of the storage tank and each other that there is created a stagnant space therebetween for protecting the integrity of the diffusional path length of the sealing means located closest to the given liquid being stored, the distance between both of said sealing means being preferably maximized for a given liquid while the volume between said sealing means is being preferably minimized, thereby providing for containment, within the confines of said sealing arrangement, of vapor resulting from evaporation of liquid remaining on the inner surface of such storage tank as such floating roof is moved downwardly due to diurnal contraction or unloading of such liquid from such tank, the small volume producing an easily vapor saturated volume for preventing substantial vapor diffusion past said sealing arrangement;

means, positioned between said first and second sealing means for minimizing the volume therebetween; and means for attaching said first and second sealing means to such floating roof in a sealed relationship thereto.

10. The sealing arrangement of claim 9 further including means for evacuating the space provided between said first and second sealing means for capturing vapors located therein, whereby vapor emitting from such storage tank is reduced.

11. The sealing arrangement of claim 9 further including means for at least partially filling the space provided between said first and said second sealing means with an inert gas for reducing vapor diffusion through said sealing arrangement and inerting the atmosphere contained therebetween.

12. The sealing arrangement of claim 9 further including a weather seal member pivotally attached to such floating roof above said first and second sealing means for protecting at least the uppermost one of said sealing means from the ambient elements and for preventing substantial amounts of precipitation from entering the storage tank through said sealing arrangement.

13. The sealing arrangement of claim 9 in which the lowermost one of said sealing means is attached to such floating roof such that it is supported in sealing association with such innter surface of such storage tank above the liquid level in such tank, thereby reducing the upward capillary action effect of such liquid upon said sealing means.

14. The sealing arrangement of claim 9 in which the vertical distance between said first and second sealing means is equal to or greater than the maximum normal rate of descent of such floating roof, as a result of diurnal contraction of liquid unloading, multiplied by the time necessary for substantially all of the evaporable liquid residing on the iner surface of the storage tank to evaporate, whereby substantially all of such vapor is captured within the confines of said sealing arrangement.

15. The sealing arrangement of claim 14 in which said first and said second sealing means function both as diffusion seals and as wiping elements for wiping off at least some of the liquid remaining on the inner surface of such storage tank during descension of such floating roof such that the evaporable liquid remaining subsequent thereto will substantially evaporate within the confines of said sealing arrangement.

16. The sealing arrangement of claim 9 in which each of said sealing means is configured having a generally toroidal shape, the vertical length of sealing contact of each of said sealing means with such inner surface of such storage tank being approximately equal to the radial distance between such floating roof and such inner surface.

17. A high efficiency, low emission vapor sealing system adapted for use in an open top hydrocarbon liquid storage tank, said sealing system comprising:

a floating roof configured to float upon the given liquid located within such tank, said floating roof being of a diameter slightly smaller than that of such storage tank;

first diffusional sealing means, attached to a portion of said floating roof, said first sealing means being in substantially continuous slideable engagement with the inner surface of said storage tank for sealing the annular space between said floating roof and such inner surface against vapor escaping therethrough from the evaporating hydrocarbon liquid to the ambient atmosphere;

second diffusional sealing means, attached to said floating roof vertically removed from said first sealing means, said second sealing means being in substantially continuous slideable engagement with such storage tank inner surface for sealing the annular space between said floating roof and such inner surface, both said sealing means being of effective vapor sealing efficiency and having relatively large vertical lengths of contact with such inner surface for reducing diffusion of vapor from such hydrocarbon liquid past said sealing means to the ambient atmosphere, said first and second sealing means being so arranged relative to said floating roof, such inner surface, and each other that there is provided a stagnant space therebetween for protecting the integrity of the diffusional path length of the sealing means closest to the liquid being stored and confining the effects of wind to the upper sealing means, the distance between said sealing means being maximized while the annular volume between the two is minimized, thereby providing for containment within the space provided between said sealing means of vapor resultant from the evaporation of the given liquid remaining on such inner surface as said floating roof is moved downwardly due to diurnal contraction or unloading of such liquid from such storage tank, the decreased volume resulting in an easily saturated vapor space for reducing vapor diffusion past said sealing means;

means, positioned between said first and second diffusional sealing means for reducing the volumetric space between the two, said volume reducing means remaining out of engagement with said storage tank; and a weather seal, positioned above both of said sealing means and attached to said floating roof so as to be in slideable engagement with such inner surface for protecting said sealing means for the ambient elements and preventing precipitation and the like from entering the storage tank and contaminating the liquid stored therein.

18. The sealing system of claim 17 in which said volume reducing means is a urethane log configured to fit between said first and second sealing means and filling the volume therebetween except for an area proximate the inner surface of said storage tank.

19. The sealing system of claim 17 in which said volume reducing means is a bladder element capable of receiving gas or foam and substantially filling the volume between said first and second sealing means, except in an area proximate the inner surface of said storage tank, said volume reducing means including an element for limiting the outward expansion of said bladder element with said storage tank inner surface when said bladder element is filled to fill said volume.

20. A high efficiency, low emission vapor sealing system adapted for use in an open top hydrocarbon liquid storage tank, said sealing system comprising:

a floating roof configured to float upon the given liquid located within such tank, said floating roof being of a diameter slightly smaller than that of such storage tank;

first diffusional sealing means, attached to a portion of said floating roof, for sealing the annular space between said floating roof and such inner surface against vapor escaping therethrough from the evaporating hydrocarbon liquid to the ambient atmosphere;

second diffusional sealing means, attached to said floating roof vertically removed from said first sealing means for sealing the annular space between said floating roof and such inner surface, said first and second sealing means being so spaced from each other a distance sufficient to contain, for a given liquid, within the space provided between said sealing means, vapor resultant from the evaporation of evaporable liquid remaining on such inner surface as said floating roof is moved downwardly due to diurnal contraction or unloading of such given liquid from such storage tank;

means for minimizing the volume between said first and second diffusional sealing means for creating a more easily saturated space therebetween for reducing subsequent hydrocarbon evaporation to said space when said space is saturated, thereby reducing total vapor loss through said sealing system to the atmosphere; and a weather seal, positioned above both of said sealing means and attached to said floating roof so as to be in slidable engagement with such inner surface for protecting said sealing means for the ambient elements and preventing precipitation and the like from entering the storage tank and contaminating the liquid stored therein.

* * * * *

UNITED STATES PATENT AND TRADEMARK OFFICE

CERTIFICATE OF CORRECTION

PATENT NO. : 4,099,644

DATED : July 11, 1978

INVENTOR(S) : Wayne E. Nuttall, William H. Page

It is certified that error appears in the above-identified patent and that said Letters Patent are hereby corrected as shown below:

Column 1, line 47, change "the" to -- a --.

Column 2, line 38, change "less" to -- loss --.

Column 2, line 63, change "Vapos" to -- Vapors --.

Column 4, line 19, change "Examplary" to -- Exemplary --.

Column 6, line 8, change "." to -- ; --.

Column 11, line 64, after "minimized" delete "to".

Column 12, line 16, change "tuning" to -- tubing --.

Column 14, line 45, change "a" to -- as --.

Column 18, line 22, change "innter" to -- inner --.

Signed and Sealed this

*Twelfth* Day of *June 1979*

[SEAL]

*Attest:*

RUTH C. MASON
*Attesting Officer*

DONALD W. BANNER
*Commissioner of Patents and Trademarks*